US007551521B2

(12) United States Patent
Someya

(10) Patent No.: US 7,551,521 B2
(45) Date of Patent: Jun. 23, 2009

(54) TIME INFORMATION RECEIVER AND RADIO CONTROLLED WATCH

(75) Inventor: Kaoru Someya, Kiyose (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 12/077,859

(22) Filed: Mar. 21, 2008

(65) Prior Publication Data

US 2008/0239879 A1 Oct. 2, 2008

(30) Foreign Application Priority Data

Mar. 26, 2007 (JP) ..... 2007-079870

(51) Int. Cl.
*G04C 11/02* (2006.01)

(52) U.S. Cl. ..... 368/47; 375/354

(58) Field of Classification Search ..... 368/46, 368/47

See application file for complete search history.

(56) References Cited

U.S. PATENT DOCUMENTS

2003/0117901 A1* 6/2003 Takada et al. ..... 368/47
2005/0094495 A1* 5/2005 Takada et al. ..... 368/47
2006/0067166 A1* 3/2006 Murata et al. ..... 368/47

FOREIGN PATENT DOCUMENTS

JP 11-211858 A 8/1999
JP 2005-249632 A 9/2005

OTHER PUBLICATIONS

Related U.S. Appl. No. 12/077,860, filed Mar. 21, 2008; Inventor: Kaoru Someya; Title: Time Information Receiver and Radio Controlled Watch.

* cited by examiner

*Primary Examiner*—Renee Luebke
*Assistant Examiner*—Jason Collins
(74) *Attorney, Agent, or Firm*—Frishauf, Holtz, Goodman & Chick, P.C.

(57) ABSTRACT

A time information receiver and radio controlled watch that receives a time code in which different data pulses are disposed one in a unit period. A composite signal waveform of a plurality of detected signals of the time code shifted sequentially by a unit period of 1 second is obtained by sample adders. A start point of each unit period is detected from the composite signal waveform as a seconds synchronization point where the receiver and watch is seconds-synchronized with the time code. An accurate seconds synchronization point is detected from the detected signal even when the same includes a considerable noise.

6 Claims, 9 Drawing Sheets

TIME INFORMATION RECEIVER AND RADIO CONTROLLED WATCH

FIELD OF THE INVENTION

The present invention relates to time information receivers that receive a time code carried by a standard time and frequency signal, and radio controlled watches that correct their times based on the time code.

BACKGROUND ART

A radio controlled watch is known which receives a time code to correct time thereof. The time code has a predetermined format of successive frames of 60 seconds with each frame including 60 data pulses one occurring in an unit period of 1 second. The time code now in use in Japan includes a "P" signal that is high for 0.2 seconds from a start of a unit period, a "0" signal that is high for 0.5 seconds from a start of a unit period, and a "1" signal that is high for 0.8 seconds from a start of the unit period. Among these signals, the "P" signal is defined as a frame marker which indicates a start of each of the frames of the time code and serves also as a position marker which indicates each of divisions for data such as minutes, hours, days and years. Moreover, the "0" and "1" signals represent binary "0" and "1", respectively, which can be applied to a time code format, thereby calculating a current exact time and date represented in minutes, hours, day, month, and year. A seconds synchronization point where, for example, a watch can be seconds-synchronized with the standard signal is represented by a rise of each data pulse. The time code, for example, AM-modulated, is carried by the standard signal, which is of 40 or 60 kHz, but a clear signal waveform indicative of the time code can not be received due to diffused reflections/attenuations in buildings and mixing of turbulent noise.

In the past, some propositions have been made which try to detect a seconds synchronization point in the time code accurately from the standard time and frequency signal even when the same contains noise. Japanese Patent Application TOKKAIHEI 2005-249632 discloses a technology that tries to detect a bit (or seconds) synchronization point by binarizing the detected signal at intervals of 0.1 seconds, listing groups of binarized data each for one second, and converting these groups of data to a step-like graph.

In the above-mentioned method, when the detected signal contains a little noise, the seconds synchronization point is detectable from a binarized version of the detected signal. However, if the detected signal contains a considerable noise such as would make it impossible to recover the original data pulses, the seconds synchronization point is not detectable.

An object of the present invention is to provide a time information receiver and radio controlled watch capable of detecting a seconds synchronization point with high accuracy from the detected signal even when the same contains a considerable noise.

SUMMARY OF THE INVENTION

In accordance with the present invention, the above object is achieved by a time information receiver which receives a time code in which different data pulses are disposed one in a unit period. The receiver comprises: a composer that sequentially shifts a detected signal of the time code by the unit period at a time to produce a plurality of different shifted versions of the detected signal, thereby generating a composite signal waveform of the plurality of different shifted versions of the detected signal; and a synchronization detector that detects a synchronization point where the composite signal waveform rises sharply in a unit period of the composite signal waveform and where the receiver is synchronized with the time code.

According to the present invention, the composite signal waveform is composed of the plurality of different shifted versions of the detected signal, one shifted by the unit period from another. Thus, any possible noises contained in the detected signal is averaged and eliminated from the composite signal. Further, in the composite signal waveform, the different data pulses rise at the synchronization point. Accordingly, even when the time code contains a considerable noise, the synchronization point is detected with high accuracy from the composite waveform of the plurality of different shifted versions of the detected signals.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE INVENTION

First Embodiment

Figure 1:
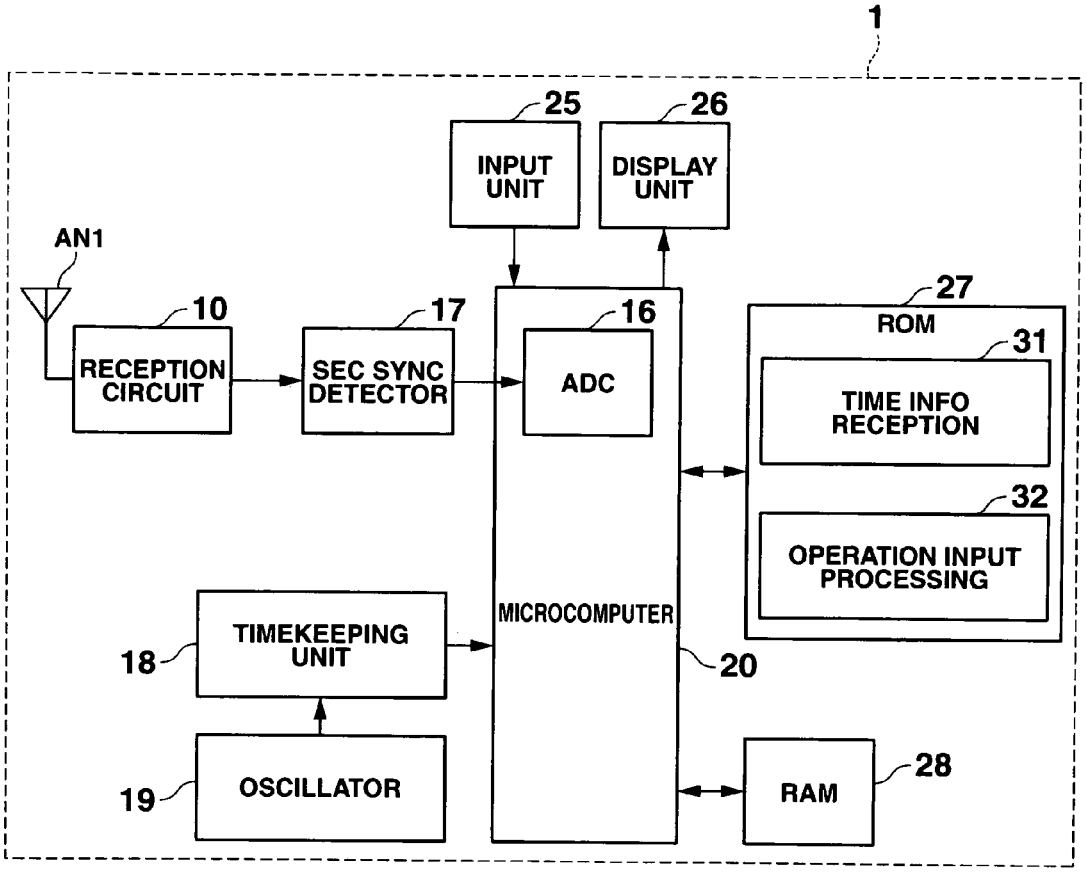
FIG. 1 is a block diagram of a radio controlled watch according to a first embodiment of the present invention.

Referring to FIG. 1, there is shown a radio controlled watch 1 of a first embodiment of the present invention. The watch includes a time information receiver which receives a standard time and frequency signal where a time code is included and which corrects the time thereof automatically in accordance with the time code. The radio controlled watch 1 comprises an internal antenna AN1 that receives the standard time and frequency signal, a reception circuit 10 that detects a target signal from the standard signal, a seconds synchronization detector 17 that detects a seconds synchronization point from the detected signal, a timekeeping circuit 18, an oscillator 19 that provides clock pulses to the timekeeping circuit 18, a microcomputer 20 that controls the whole of the watch 1, an input unit 25 that inputs operation signals generated by operation button switches (not shown) to the microcomputer 20, a display 26 that displays time based on time data from the timekeeping circuit 18, a ROM 27 that has stored control programs and control data, and a RAM 28 which provides a working memory space. The time information receiver is composed of the reception circuit 10, the seconds synchronization detector 17, and the microcomputer 20. The synchronization detector 17 may be implemented in software with the aid of the microcomputer 20.

The microcomputer 20 includes a CPU, an I/O unit that receives and outputs data from and to peripheral devices, and an A/D converter 16 that samples analog data from the seconds synchronization detector 17 (The A/D converter 16 may be provided outside the microcomputer 20). The CPU executes the control programs stored in the ROM 27 while using the memory space of RAM 28. For example, the ROM 27 has stored an operation input signal processing program 32 to execute various processing operations based on operation signals from the input unit 25, and a time information reception/seconds data correction program 31 that corrects the seconds synchronization of the watch based on the time code of the received standard signal. Additionally, the ROM 27 has stored a time correction program which determines each data pulse in the time code and resets the years/months/days/hours/minutes/seconds data of the watch.

Figure 2:
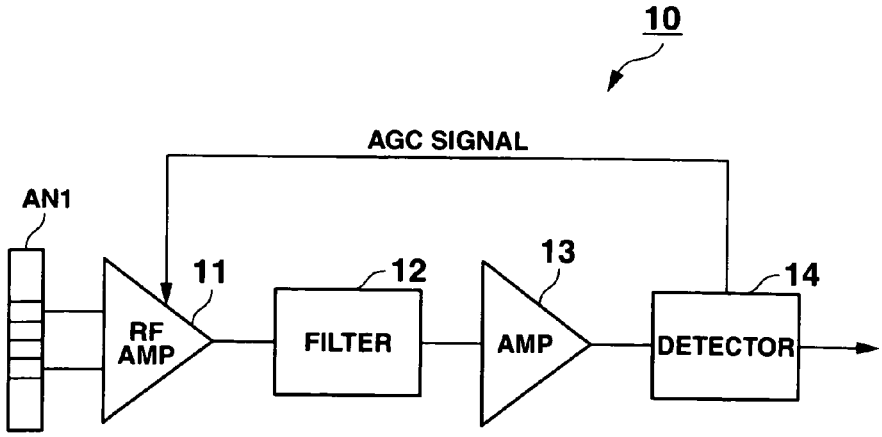
FIG. 2 shows the composition of a reception circuit of the watch.

FIG. 2 shows the composition of the reception circuit 10 of FIG. 1, which has an RF amplifier 11 that amplifies a signal received by the antenna AN1, a band-pass filter 12 that allows signals of the frequency band of the standard signal to pass therethrough, an amplifier 13 that amplifies the signals that have passed through the filter 12, and a detector 14 that demodulates a time code signal from the output of the amplifier 13. The detector 14 sends a gain control (AGC) signal to the RF amplifier 11 to keep the amplitude of the detected signal to be constant.

Figure 3:
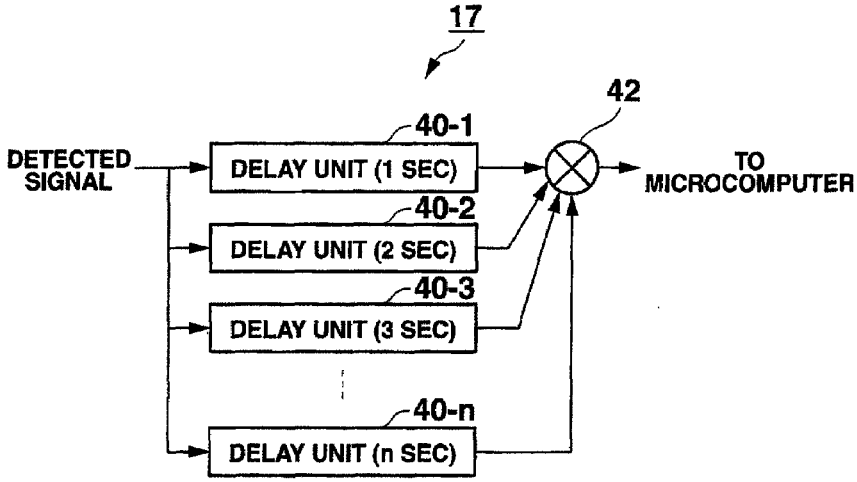
FIG. 3 shows one specified example of a seconds synchronization detector of the watch.

FIG. 3 shows a specified example of the seconds synchronization detector 17 of FIG. 1, which is composed of a plurality of delay elements 40-1 to **40-*n* that receive a detected signal from the detector 14, delay the signal by 1, 2, 3, . . . , and n seconds in this order ("1" second is the length of a unit period in which a single data pulse of the time code is disposed) and output resulting signals, and an adder 42 that adds up the amplitudes of these signals from the delay elements 40-1 to 41-*n* into a composite signal. The adder 42** may output either a resulting composite signal as it is, or a scaled-down version of the composite signal.

Figure 4:
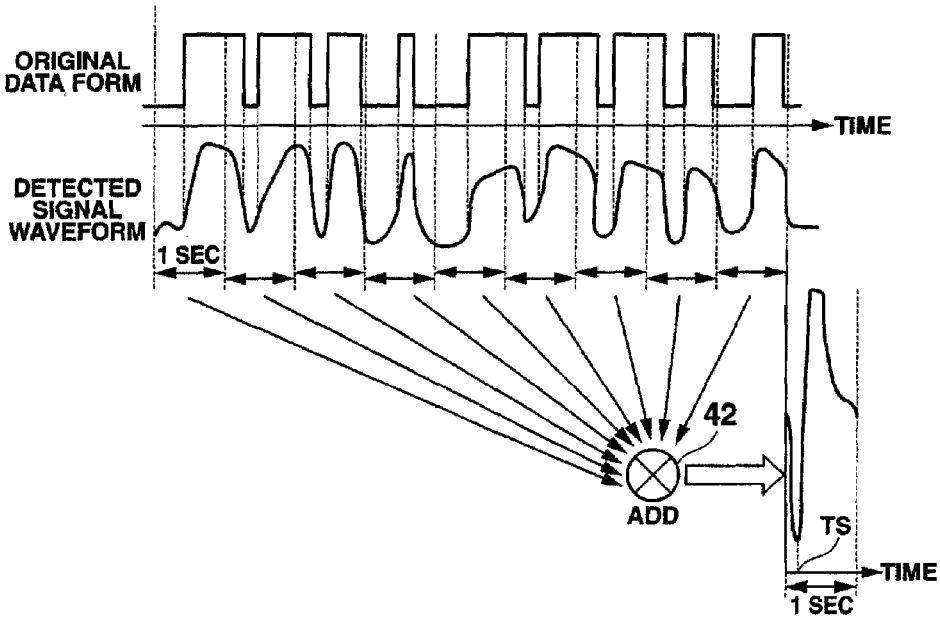
FIG. 4 illustrates operation of the seconds synchronization detector.

FIGS. 4 illustrate operation of the seconds synchronization detector 17. As shown in FIG. 4, when receiving the detected signal containing noises, the seconds synchronization detector 17 adds up in the adder 42 the respective waveform sections of the detected signal shifted sequentially by one second. This produces a composite signal similar to one in which the noise components are averaged and eliminated. In addition, if the detected signal contains no noise components, it takes a pulse-like waveform such as shown in FIG. 4 where all the pulses rise at the same corresponding time point TS in their 1-sec periods. Thus, the composite signal shows a sharp rise at that time point TS (which can be hereinafter referred to as "rise point") in each of the 1-sec periods of the detected signal. Each of data pulses (or P, "0", and "1" signals) of the time code is necessarily low for 0.2 seconds immediately before its rise and necessarily high for 0.2 seconds immediately after its rise. That is, there are periods where the composite signal is low and high before and after, respectively, the rise point TS.

That is, the microcomputer 20 A/D converts the composite signal, internally processes the same and detects the rise point TS as a seconds synchronization point where the watch 1 is synchronized with the time code. More specifically, the microcomputer 20 first samples the composite signal in its A/D converter (not shown) at short intervals of time. The A/D converter has a gradation of 4 bits or more. Then, the microcomputer 20 calculates differences each between amplitudes of the composite signal at a respective one of pairs of adjacent time points spaced at predetermined intervals along an axis of time, using those sampled data. Then, the microcomputer 20 locates a time point, where the difference in amplitude is larger than a predetermined value, as a rise point of the composite signal and handles it as the seconds synchronization point.

Next, a time information reception/seconds data correction process will be described which corrects the movement of the seconds hand of the watch by the microcomputer 20 with respect to FIG. 5. This process is performed at several predetermined times per day or compulsively by the user. When this process starts, the seconds synchronization detector 17 is operated and the CPU waits, for a predetermined time, for example, of 10 seconds, for the seconds synchronization detector 17 to add up the sequentially delayed detected signals, thereby producing a composite signal (step S1).

Then, the CPU receives the composite signal from the seconds synchronization detector 17 and detects a seconds synchronization point from the composite signal (step S2). More specifically, the microcomputer 20 sequentially samples the composite signal in the A/D conversion and sequentially compares sampled values at respective adjacent time points spaced along the axis of time, locates a point where the composite signal rises sharply as a seconds synchronization point. Then, the CPU calculates a difference in time between the seconds synchronization point and seconds data from the timekeeping circuit 18 (step S3), and then determines whether the difference in time is within a predetermined time, for example, of less than 0.5 seconds (step S4). In this embodiment, only the seconds synchronization point is detected, and no differences in time involving minutes and seconds cannot be calculated. However, whether the difference in time is less than 0.5 seconds can be determined by confirming whether the time information reception/seconds data correction process performed in the past was terminated normally. That is, when it is known that the timekeeping circuit 18 is fast or slow by ±0.4 seconds a day, and if there is a time information reception/seconds data correction process that has been terminated within one day among the past time information reception/seconds data correction processes, it is determined that the difference in time is less than 0.5 seconds. Otherwise, it is determined that the difference in time is not less than 0.5 seconds.

When it is determined as a result of the determination in step S4 that the difference in time is within a predetermined time, for example, of less than 0.5 seconds, the operation goes to step S5 to correct the seconds data of the timekeeping circuit 18. If it is determined that the difference in time is more than the predetermined time, the time correction cannot be performed only in the seconds synchronization process. Thus, the operation goes to a step to receive the whole time code, but its further description will be omitted.

Figure 6:
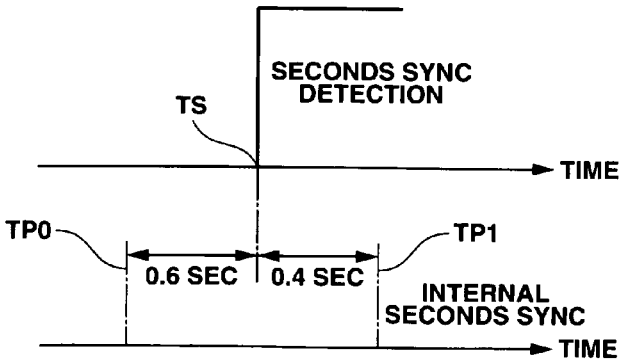
FIG. 6 illustrates a method of correcting seconds data produced by the watch after detection of a seconds synchronization point.

In step S5, first, it is determined whether the seconds data of the timekeeping circuit 18 is fast or slow relative to the seconds synchronization point TS of the composite signal. As shown in FIG. 6, when the detected seconds synchronization point TS is closer to a seconds synchronization point TP1 of the timekeeping circuit 18 than its seconds synchronization point TP0 preceding the point TP1, the difference in time should be less than 0.5 seconds. Thus, it is determined that the seconds data of the timekeeping circuit 18 is slow compared to the detected seconds synchronization point TS. Conversely, if the seconds synchronization point TS is closer to the seconds synchronization point TP0, it is determined that the seconds data of the timekeeping circuit 18 is fast.

When the seconds data of the timekeeping circuit 18 is fast, the difference in time is added to the seconds data of the timekeeping circuit 18, thereby correcting its time (step S6). Conversely, if it is determined that the seconds data of the timekeeping circuit 18 is slow, the difference in time is subtracted from the seconds data of the timekeeping circuit 18, thereby correcting its time (step S7). Then, this process is terminated.

As described above, according to the radio controlled watch 1 and the time information receiver of this embodiment, a composite signal is obtained by adding up detected signals of the time code shifted sequentially one second by the seconds synchronization detector 17. Thus, the composite signal exhibits a point TS as the seconds synchronization point where a noiseless clear pulse rises. Thus, even when the time code contains a considerable noise, the seconds synchronization point is detected easily and accurately from the composite signal. This causes correction of the seconds data of the radio controlled watch 1 and setting of a synchronization point with high accuracy when the time code is received.

Second Example of the Seconds Synchronization Detector

Figure 7:
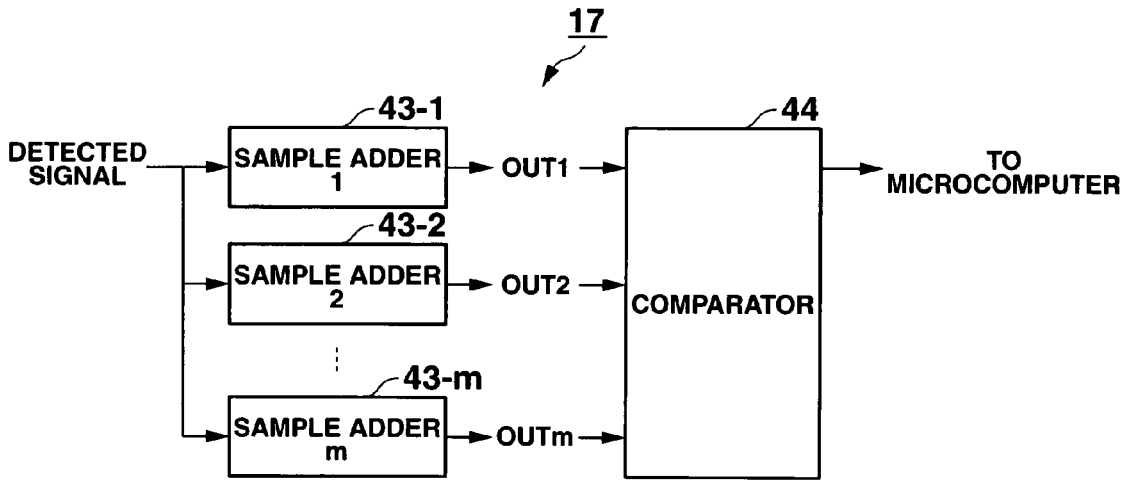
FIG. 7 shows a second example of the seconds synchronization detector.

Referring to FIG. 7, a second example of the seconds synchronization detector 17 is shown which is composed of m sample adders 43-1 to **43-*m* and a comparator 44** which compares the respective outputs from the sample adders.

Figure 8:
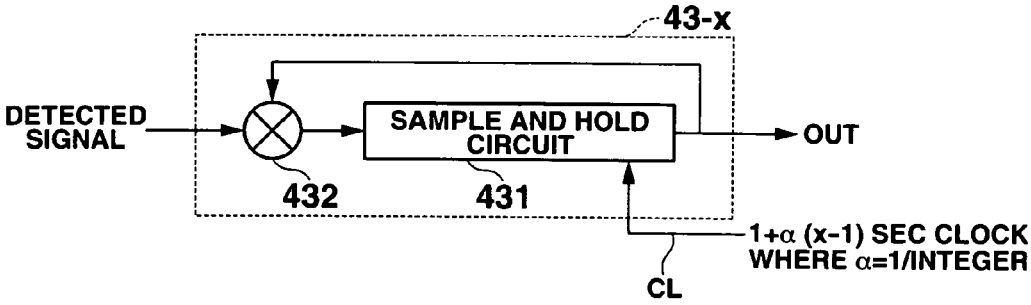
FIG. 8 is a block diagram of a sample adder of the FIG. 7.

As shown in FIG. 8, each sample adder **43-*x* comprises a sample and hold circuit 431 that samples and holds a received signal voltage sequentially based on latch clocks CL received at intervals of 1 second and an adder 432 which adds up an output from the sample and hold circuit 431 and a detected signal voltage received from the reception circuit 10. Although latch clocks CL are inputted at intervals of 1 second to each of the sample adders 43-1 to 43-*m*, the respective times when the latch clocks CL are inputted to the different sample adders 43-1 to 43-*m*** differ by a small interval of time, for example, of 1/m seconds (=a unit period of the time code/the number of sample adders).

Figure 9:
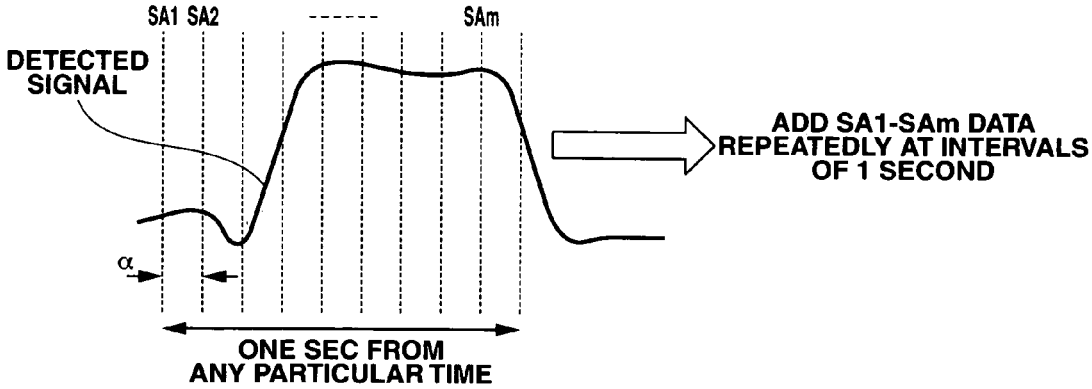
FIG. 9 illustrates operation of the seconds synchronization detector of the second example.

FIG. 9 illustrates operation of this synchronization detector 17. For example, the first sample adder 43-1 repeatedly adds to a possible previous remaining voltage value a voltage of the detected signal at a predetermined particular time point SA1 in each period of 1 second. Likewise, the second sample adder 43-2 repeatedly adds to a possible previous remaining voltage value a voltage of the detected signal at a predetermined particular time point SA2 later by 1/m seconds than the time point SA1 in each period of 1 second. Such addition is performed likewise in all other (m-2) sample adders 43-3 to **43-*m*** at time points sequentially shifted by 1/m seconds.

Thus, each of the output voltages Out1-Outm from the m sample adders 43-1 to **43-*m* represents waveform data of a composite signal obtained by adding up the amplitudes of the detected signals sequentially shifted at intervals of 1 second. For example, when 10 sample adders 43-1 to 43-10 sample and add up the detected signals for 10 seconds, the output voltages Out1-Out10 from the sample adders 43-1 to 43-10 represent respective amplitude data obtained by sampling, at intervals of 0.1 seconds, a composite signal which is obtained by adding up the detected signals ten times at intervals of 1 second. That is, the output voltages Out1-Out10 are equal to respective data obtained by sampling, at intervals of 0.1 seconds, the composite signal of FIG. 4, described with respect to the first embodiment. Thus, a seconds synchronization point is detected as a point TS of the composite signal from the output voltages Out1-Out10**.

The comparator 44 sequentially compares all adjacent ones of the output voltages Out1-Outm, i.e. Out1 and Out2, Out2 and Out3, . . . , and Out(m-1) and Outm to detect a point where the difference exceeds a predetermined value. As for the output Outm of the last sample adder **43-*m*, the comparator 44 compares the output voltages Outm and Out1 from the last and first sample adders 43-*m* and 43-1, respectively. If there is a point where the difference in voltage exceeds the predetermined value, that point is regarded as a seconds synchronization point TS (FIG. 4) of the composite signal. This data is then delivered to the microcomputer 20**.

The microcomputer 20 recognizes this seconds synchronization point from the comparator 44 and uses this point data to correct the seconds data of the timekeeping circuit 18 and to set a synchronization point with high accuracy. For example, assume that a time point SA1 when a latch clock LC is inputted to the first sample adder 43-1 is set to a synchronization point of the seconds data counted by the timekeeping circuit 18, and that a point TS of the composite signal is detected. In this case, a difference in time between the synchronization point of the seconds data of the timekeeping circuit 18 and the seconds synchronization point detected from the composite signal can be calculated, thereby allowing the seconds data of the timekeeping circuit 18 to be synchronized with the seconds synchronization point detected from the composite signal.

Third Example of the Seconds Synchronization Detector

Figure 10:
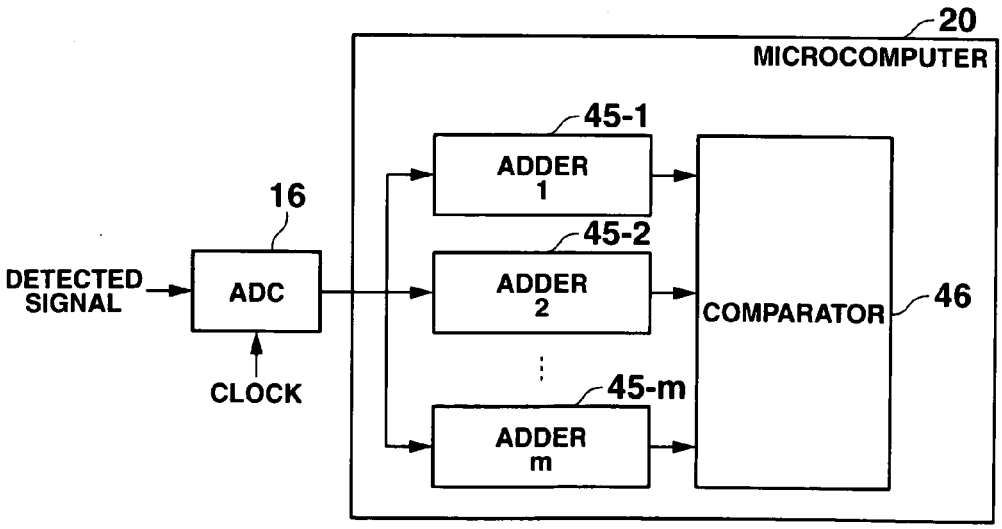
FIG. 10 is a block diagram of a third example of the seconds synchronization detector.

Referring to FIG. 10, a third example of the seconds synchronization detector is shown which is formed in software within the microcomputer 20 and performs operation similar to the operation performed in the seconds synchronization detector of FIG. 7.

In this example, an A/D converter 16, for example, with a gradation of 4 bits or more, A/D converts and samples a detected signal from the reception circuit 10 at intervals of a fraction (for example, 0.1 seconds) of a unit period of 1 second, and sends a resulting signal to the microcomputer 20.

M adders 45-1 to **45-*m* and a comparator 46 formed by software and similar in function to the FIG. 7 m adders 43-1 to 43-*m* and comparator 44, respectively, are operated with the aid of the microcomputer 20** so as to detect a rise point in the waveform of the composite signal.

Figure 11:
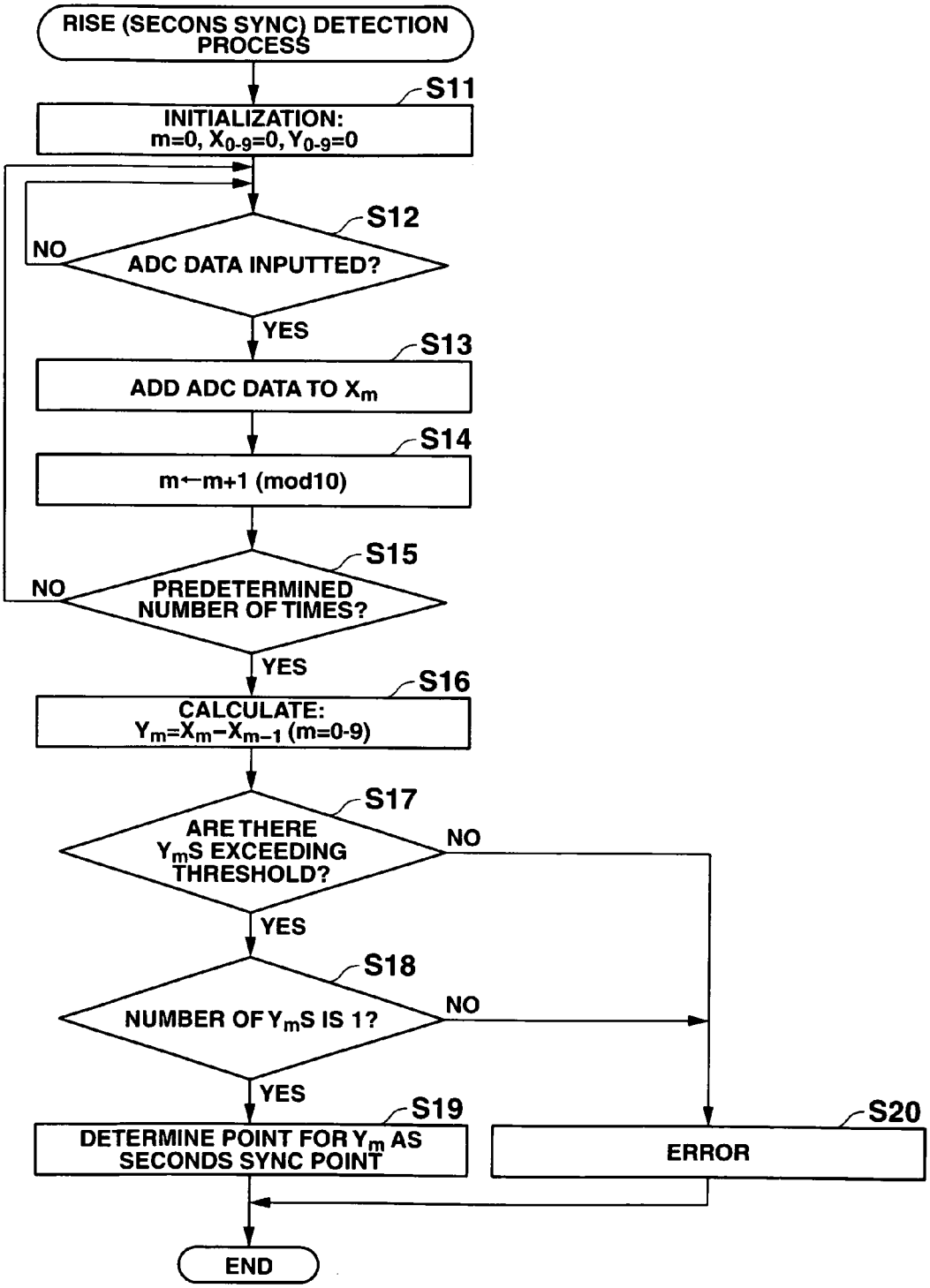
FIG. 11 is a flowchart of a seconds synchronization detection process to be performed in the seconds synchronization detector of FIG. 10.

In operation, it is assumed that the number of adders 45-1 to **45-*m* is 10. The seconds synchronization point of the time code is detected in a flowchart of FIG. 11 as follows. When detection of a rise point (or seconds synchronization point) of a data pulse contained in the time code is required, first, an index, m, indicative of an adder 45-*m* and $X_{0\text{-}9}$ which indicates a result of adding up an amplitude value of the detected signal and a possible previous remaining value, and a variable $Y_{0\text{-}9}$ indicative of a difference value between adjacent variables $X_i$ and $X_{i\text{-}1}$ are initialized to 0 (step S11**).

After the initialization, output data from the A/D converter 16 is inputted to a first variable $X_1$ as the first adder 45-1 (step S12). This data is then added to a previous remaining value (in this case, 0) in the adder $\mathbf{45}_1$ (step S13). Then, the value of the index, m, is incremented (step S14).

It is then determined whether data is inputted from the A/D converter 16 a predetermined number of times, for example, for 10 seconds to the microcomputer 20 (step S15). If so, the operation goes to step S16. Otherwise, the operation returns to step S12. Performing the steps S12-S15 repeatedly, for example, for 10 seconds causes sampling, at intervals of 0.1 seconds, the composite signal, which is obtained by adding up the detected signals 10 times at intervals of 1 second and substituting those sampled signal values into variables $X_0$-$X_9$.

Then, differences each between a respective one of pairs of adjacent variables: i.e. $X_0$ and $X_1$; $X_1$ and $X_2$; $X_2$ and $X_3$; . . . , $X_8$ and $X_9$; and $X_9$ and $X_0$ are calculated and substituted into variables $Y_0, Y_1, Y_2, Y_3, \ldots$, and $Y_9$, respectively (step S16). When m=0, a difference between both ends variables, for example, $X_0$ and $X_9$, i.e. $Y_0=X_0-X_9$, is taken. After these calculations and substitutions are completed, it is then determined whether among the difference values $Y_1, Y_2, Y_3, \ldots Y_9$ and $Y_0$, there is one that exceeds a particular threshold (step S17). Further, it is determined whether the number of ones which exceed the threshold is only one (step S18). If the answer is Yes, a point where the difference exceeds the threshold value is determined and fixed as a seconds synchronization point (step S19). If there are no such points as exceed the threshold or there are two or more ones, error processing is performed by displaying that no seconds synchronization points cannot be detected (step S20). Then, this operation is terminated.

As described above, according to this time information receiver, no additional circuit elements are required for detection of the seconds synchronization point. Only the A/D converter that converts an amplitude of the detected signal to a digital signal and addition and comparison software to be executed by the CPU are only required to be provided additionally, in order to obtain a composite signal which is obtained by combining together amplitudes of the shifted detected signals and then detect a seconds synchronization point with high accuracy on the composite signal.

Modification of the Time Information Reception/Seconds Data Correction Process

A modification of the time information reception/seconds data correction process of FIG. 5 will be described with respect to FIG. 12. This modification can be performed in the arrangement of FIG. 7 or 10. In this process, the detected signal of the time code is inputted into the microcomputer 20, sequentially sampled and added up for 10 seconds in each adder and then a seconds synchronization point is tried to be detected on the added-up values, as mentioned above. If a seconds synchronization point cannot be detected, the same process is repeated for another 10 seconds to detect the seconds synchronization point.

Figure 12:
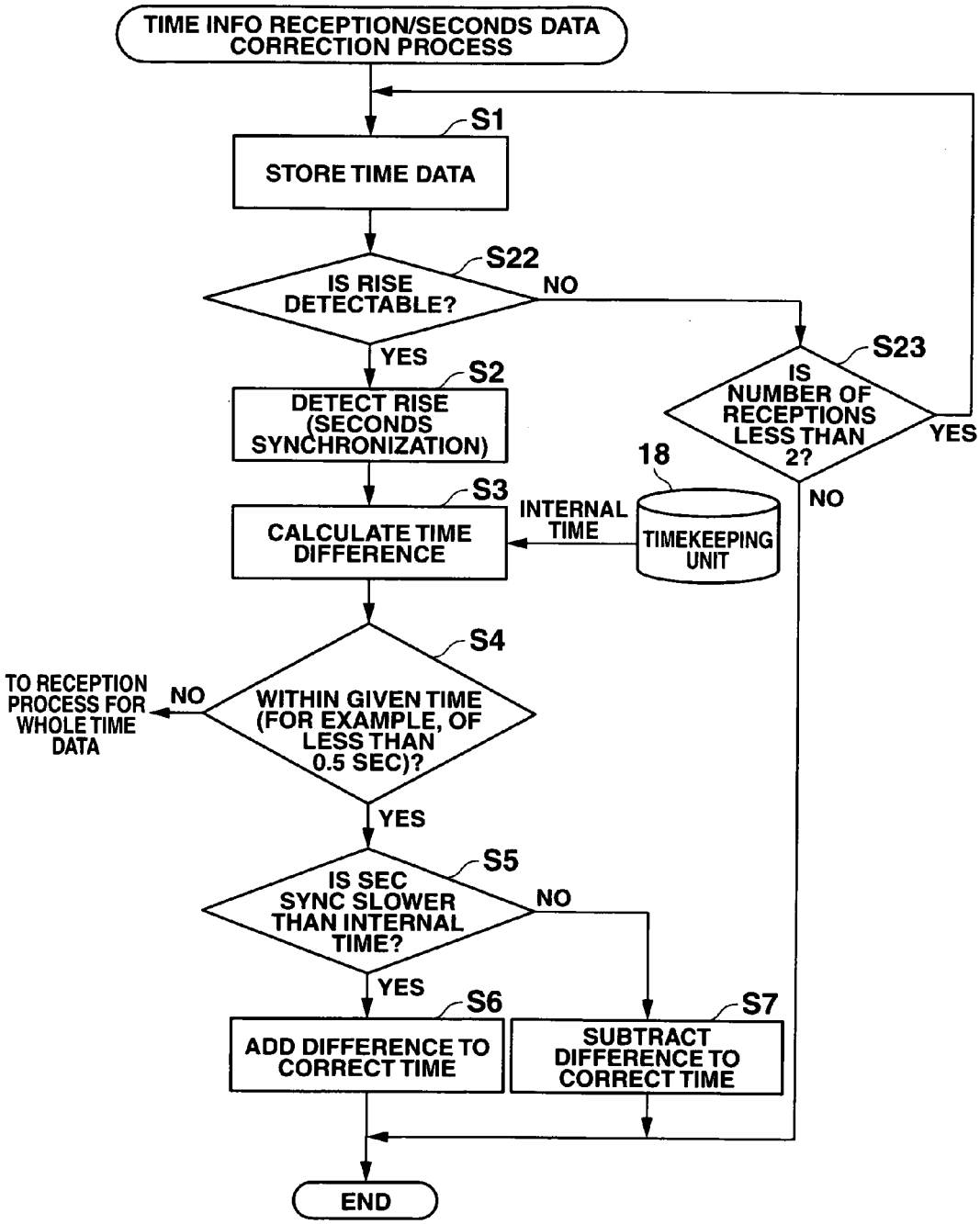
FIG. 12 is a flowchart of a modification of the time information reception/seconds data correction process.
Figure 13:
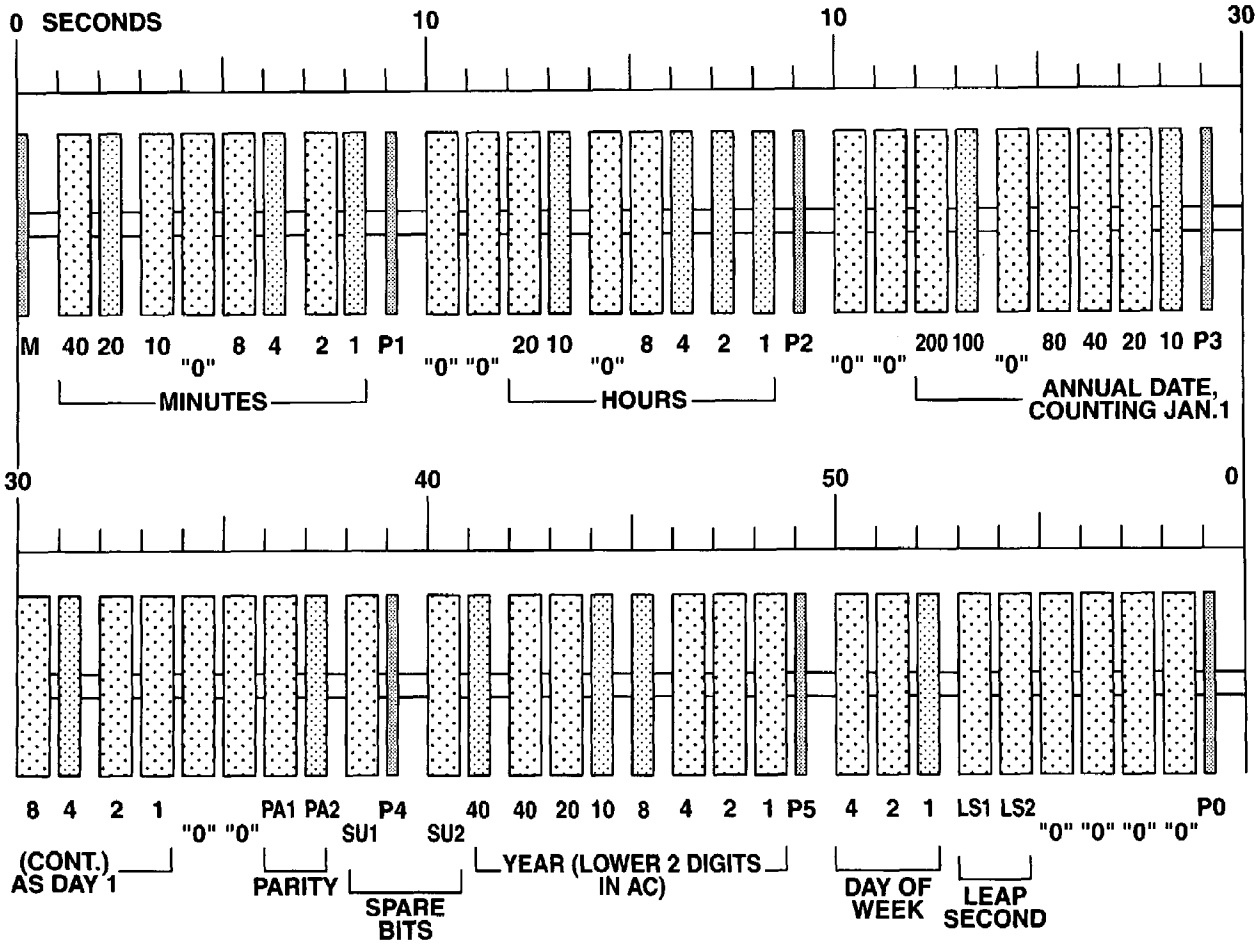
FIG. 13 illustrates a format of a time code included in a Japanese standard time and frequency signal.

When this process starts in FIG. 12, in step S21 the sampled amplitude values of the detected signal are added up in each adder for a predetermined time, for example, of 10 seconds. Then, in step S22 it is determined whether a rise point as the seconds synchronization point where a resulting waveform rises is detectable from the results of the additions. If there is no rise point or if there are a plurality of such points detected and a true rise point cannot be detected, the operation goes to step S23 to perform the addition process again.

In step S23, it is determined how many times the reception process was repeated in step S21. If the reception process is repeated twice or less, the operation returns to step S21 to again perform the addition process, which includes further adding an amplitude value of a newly inputted detected signal to the previous remaining added-up value. In this case, this addition is controlled so as to be performed 0.1 seconds after the last addition, thereby maintaining time regularity. If the operation in step S21 is repeated twice, the time information reception/seconds data correction process is terminated as a reception error.

Figure 5:
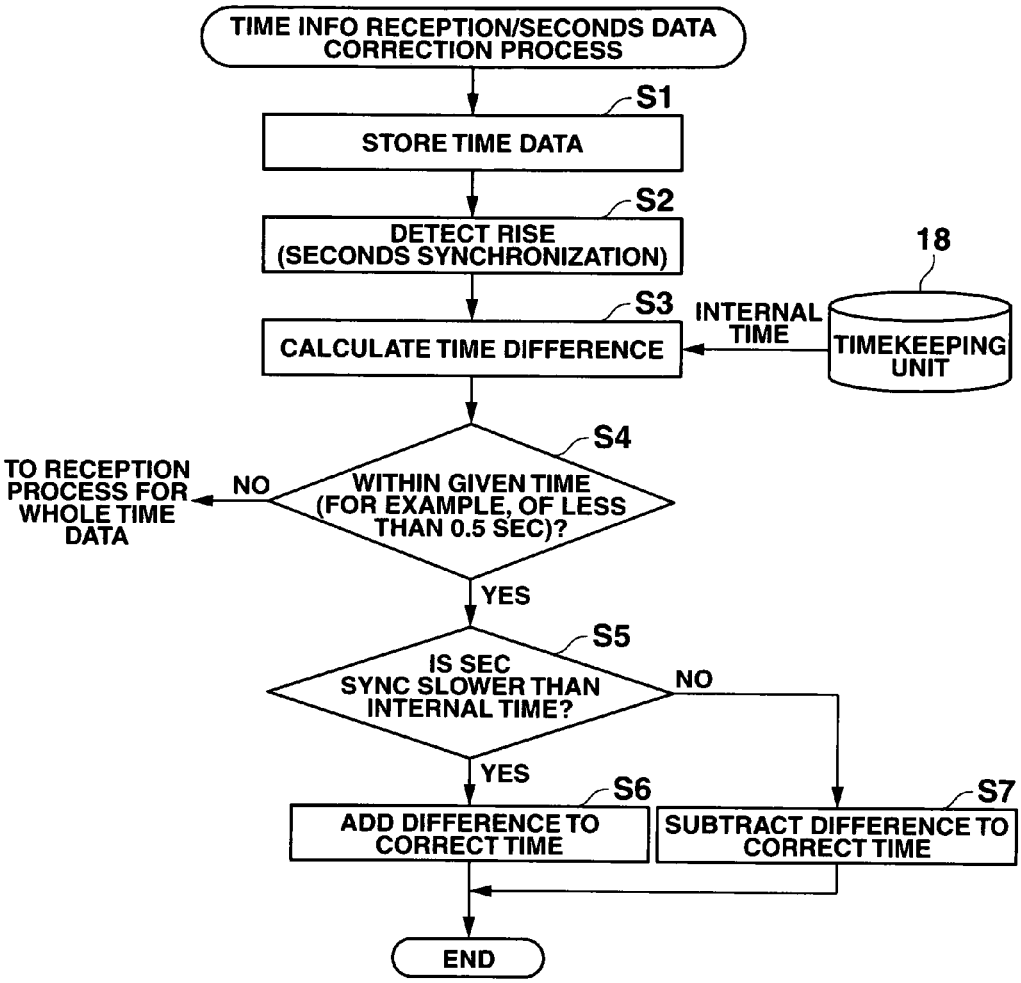
FIG. 5 is a flowchart of a time information reception/seconds data correction process which will be executed by a microcomputer of the watch.

If it is determined in step S22 that a point as the seconds synchronization point where the waveform rises is detectable, the operation goes to step S2 to correct the seconds synchronization point of the watch (steps S2-S7), which operation is similar to that explained in FIG. 5 and its further descriptions will be omitted.

As described above, according to this time information reception/seconds data correction process, when no seconds synchronization point can be detected from results of additions of the amplitude values of the detected signal for a predetermined time, the addition process is repeated for a further predetermined time such that the amplitude values of the detected signal are added to the previous remaining amplitude value, thereby trying to detect a seconds synchronization point. Therefore, when the radio wave conditions are good, the seconds synchronization point is detected in a short time whereas in bad radio wave conditions, the detection time is prolonged to detect the seconds synchronization point.

The present invention is not limited to the above-mentioned embodiments and modifications and various changes and modifications are possible. For example, while in the above embodiments and modifications the time period for which sampled amplitudes of the detected signal of the time code are added sequentially to a possible previous remaining signal in each adder at intervals of 1 second is illustrated as 10 seconds, it may be changed to another time period, for example, of 15 or 20 seconds, as required,. As the time increases, an influence of the noise on the detection of the seconds synchronization point is further reduced, thereby allowing the seconds synchronization point to be detected more precisely.

While the addition of the amplitude values of the detected signals is illustrated as performed at intervals of 1 second, they may be performed at intervals of an integer times a unit time period (of 1 second) in the time code in which one data pulse is disposed. These intervals of time are not necessarily required to be always constant, but may include, for example, a mixture of 1 and 2 seconds.

Figure 14A:
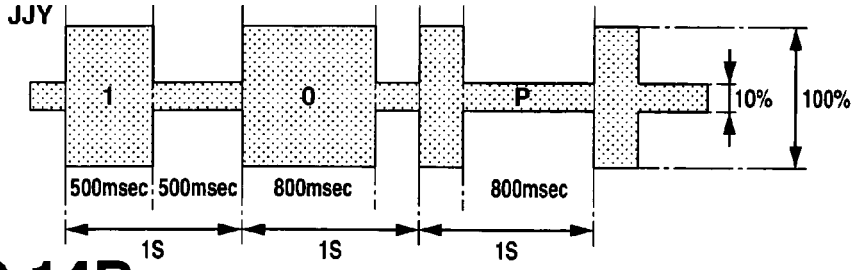
FIGS. 14A, 14B, 14C, 14D and 14E illustrate formats of data pulses composing standard time and frequency signals for use in several counties in the world.
Figure 14B:
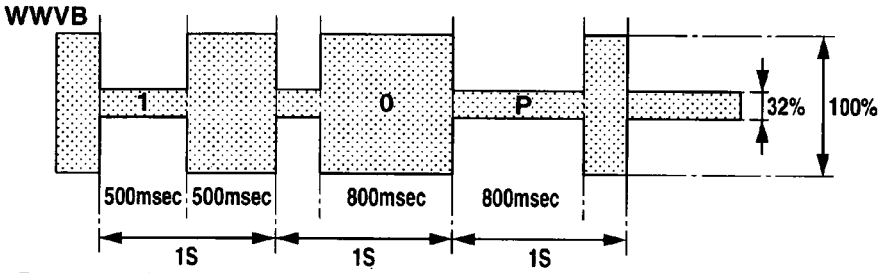
Figure 14C:
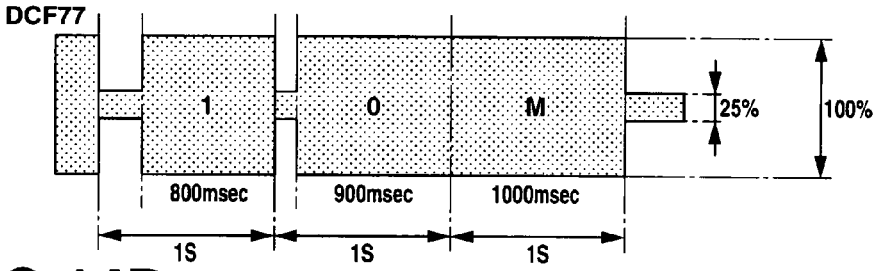
Figure 14D:
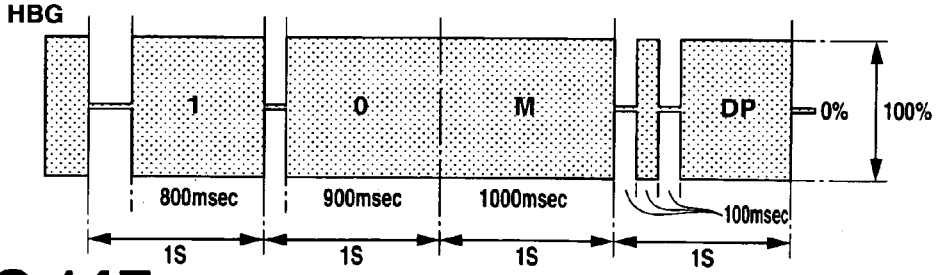
Figure 14E:
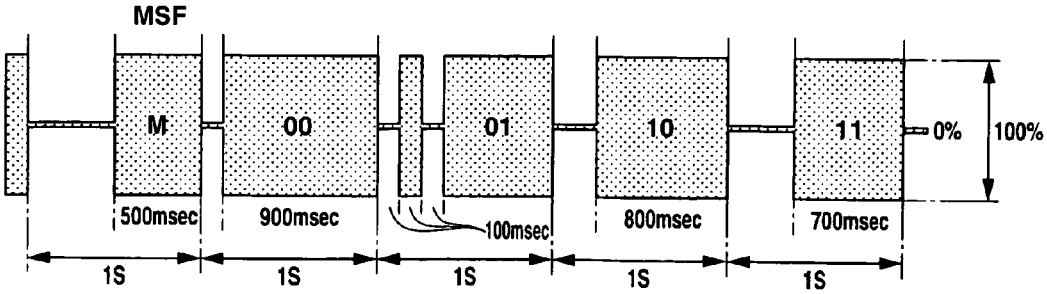

While the processing method according to the present invention is illustrated as applied to the Japanese standard time and frequency signal shown in FIG. 14A in the above embodiments, it is applicable similarly to the standard time and frequency signals for use, for example, in USA, Germany, Switzerland and Great Britain shown in FIGS. 14B, 14C, 14D and 14E, respectively, when modified somewhat in correspondence to the data pulses contained in their respective standard time and frequency signals. For example, each of the data pulses of the signals for the respective countries falls at a start point of a unit period of 1 second (or at a seconds synchronization point). Thus, the arrangement may be such that a point where a pulse falls can be located as the seconds synchronization point based on the combined waveform or the added-up amplitude value. With the signals of Germany and Switzerland, a marker signal (M) is high throughout a whole unit period and no pulses fall at a start point of the marker signal. However, since the number of marker signals to be transmitted in the detected signal is small, the influence of the marker signals on the location of the seconds synchronization point from the composite signal of the detected signals is negligible. Further, since the times when the marker signals are transmitted are known, the seconds synchronization point may be detected by inserting a process to exclude only the reception of marker signals in position into this time information reception/seconds correction process.

While in the above embodiments the time information receiver is illustrated as provided within the radio controlled watch, it may be provided in other various devices to receive the time codes or otherwise constituted as an independent one.

Various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2007-079870 filed on Mar. 26, 2007 and including specification, claims, drawings and summary. The disclosure of the above Japanese patent application is incorporated herein by reference in its entirety.

What is claimed is:

1. A time information receiver which receives a time code in which different data pulses are disposed one in a unit period, the receiver comprising:

a composer that sequentially shifts a detected signal of the time code by the unit period at a time to produce a plurality of different shifted versions of the detected signal, thereby generating a composite signal waveform of the plurality of different shifted versions of the detected signal; and a synchronization detector that detects a synchronization point where the composite signal waveform rises sharply in a unit period of the composite signal waveform and where the receiver is synchronized with the time code.

2. The time information receiver of claim 1, wherein:

the composer comprises:

a plurality of (n) delay units, where n is a natural number, an $n^{th}$ delay units delaying the detected signal of the time code by n times the unit period, thereby producing the plurality of different delayed versions of the detected signal; and a combiner that combines the plurality of different delayed versions of the detected signal into a signal waveform.

3. The time information receiver of claim 1, wherein:

the composer comprises:

a plurality of (n) adders, where n is a natural number, each adder sequentially adding up a plurality of values of the detected signal of the time code at a like number of time points spaced at intervals of the unit period; and wherein:

the times when the plurality of adders sample and add the value of the detected signal differ, one from another, by a fraction of the unit period.

4. The time information receiver of claim 3, further comprising:

a controller that, responsive to the synchronization detector failing to detect the synchronization point, causes the composer to continue to detect the synchronization point.

5. The time information receiver of claim 1, wherein:

the composer comprises:

an A/D converter that samples an amplitude of the detected signal at a first interval of time equal to a fraction of the unit period;

a plurality of adders that each sequentially receives a sampled amplitude value of the detected signal from the A/D converter at a second interval of time equal to the unit period, and adds the sampled amplitude value to a possible previous remaining sampled value; and wherein:

the times when the plurality of adders add the sampled amplitudes of the detected signal from the A/D converter differ, one from another, by the first interval of time.

6. A radio controlled watch comprising:

the time information receiver of claim 1:

a timepiece unit that keeps time; and a timepiece controller that corrects a seconds synchronization point in a period of the time kept by the timepiece unit based on the synchronization point detected by the time information receiver.

* * * * *